US005884578A

United States Patent [19]

Thostrup et al.

[11] Patent Number: 5,884,578

[45] Date of Patent: Mar. 23, 1999

[54] FLAG WITH A MEANS FOR KEEPING IT DISTENDED

[76] Inventors: Christian Thostrup, Nordre Frihavnsgade 215, Copenhagen, Denmark; John Christensen, Greve Strandvej 109, DK-2670 Greve, Denmark

[21] Appl. No.: 945,033

[22] PCT Filed: Apr. 19, 1996

[86] PCT No.: PCT/DK96/00176

§ 371 Date: Jan. 23, 1998

§ 102(e) Date: Jan. 23, 1998

[87] PCT Pub. No.: WO96/33482

PCT Pub. Date: Oct. 24, 1996

[30] Foreign Application Priority Data

Apr. 21, 1995 [DK] Denmark ..... 046495

[51] Int. Cl.[6] ..... G09F 17/00

[52] U.S. Cl. ..... 116/174; 116/173

[58] Field of Search ..... 116/173, 174, 116/63 P, 63 R, 28 R, 209; 40/591, 604

[56] References Cited

U.S. PATENT DOCUMENTS

| | | | |
|---|---|---|---|
| 975,114 | 11/1910 | Blank | 116/174 |
| 1,195,224 | 8/1916 | Hoffman . | |
| 1,294,032 | 2/1919 | Bixby . | |
| 1,339,849 | 5/1920 | Johnson et al. | 116/174 |
| 1,646,467 | 10/1927 | Walton | 116/174 |
| 1,828,892 | 10/1931 | Felton . | |
| 2,192,514 | 3/1940 | Carleton | 116/173 |
| 2,302,524 | 11/1942 | Borregard . | |
| 2,368,783 | 2/1945 | Schillinger . | |
| 2,732,823 | 1/1956 | Hanson . | |
| 3,091,215 | 5/1963 | Kenmore . | |
| 3,219,010 | 11/1965 | Hyatt | 116/173 |
| 3,239,957 | 3/1966 | Snediker | 116/174 |
| 3,678,886 | 7/1972 | Tibbet | 116/173 |
| 4,024,833 | 5/1977 | Pook et al. | 116/173 |
| 4,375,134 | 3/1983 | Sheetz | 116/173 |
| 4,603,652 | 8/1986 | Thibault et al. . | |
| 5,267,524 | 12/1993 | Maxwell | 116/173 |
| 5,291,849 | 3/1994 | Zeitler . | |
| 5,329,873 | 7/1994 | Tiballi | 116/173 |

FOREIGN PATENT DOCUMENTS 486679 11/1929 Germany .

*Primary Examiner*—Diego Gutierrez
*Assistant Examiner*—Andrew Hirshfeld
*Attorney, Agent, or Firm*—Young & Thompson

[57] ABSTRACT

The present invention relates to a flag which is adapted to keep the flag distended and appearing as natural as possible under all wind and weather conditions. The flag includes a flexible bar (1), the ends of which are retained in pockets (2 and 3) along the upper rim (4) of the flag and the rim (5) of the flag adjacent the flagpole, whereby the bar is firmly fixed and extends substantially in the plane of the flag while forming a curve extending upwards towards the upper corner of the flag adjacent the flagpole. The flag includes a fixing part (6) for the bar in an area between the pockets. The fixing part includes a strip of the flag resulting from two short cuts (7 and 8) therein.

9 Claims, 1 Drawing Sheet

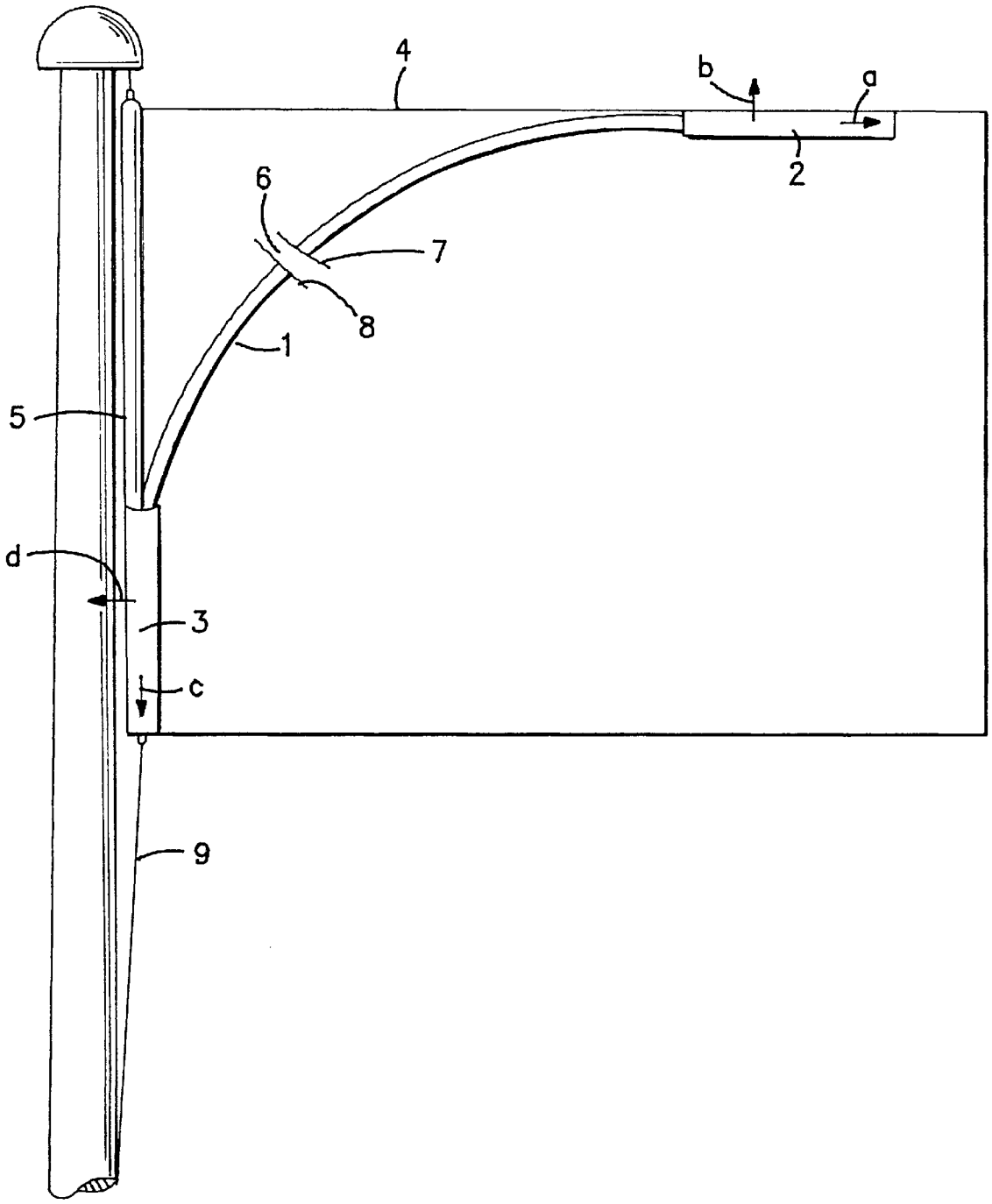
4
b
a
2
6
7
8
1
5
d
3
c
9

FLAG WITH A MEANS FOR KEEPING IT DISTENDED

TECHNICAL FIELD

The present invention relates to a flag with a means for keeping said flag distended while it is attached to a flagpole or the like. The flag is of the type usually being hoisted on a vertical flagpole.

BACKGROUND ART

Flags are known inter alia from the U.S. Pat. Nos. 2,732,823 and 3,091,215, and these flags are provided with a pocket extending diagonally from the lower corner adjacent the flagpole to the upper corner farthest away from said flagpole. A reinforcing rib is placed in the pocket. These arrangements are primarily adapted to be used in connection with strong plastic traffic flags. Problems arise, however, when these arrangements are used for flags of ordinary fabric because such flags are not kept distended so as to present a natural appearance.

Arrangements are furthermore known where the flag is hanging loosely downwards from a horizontally projecting bar arranged perpendicular to the flagpole. This flag cannot be kept distended either so as to present a natural appearance.

BRIEF DESCRIPTION OF THE INVENTION

The object of the invention is to provide a flag being kept nicely distended under all wind and weather conditions.

The flag according to the invention is characterised in that it comprises a resilient bar being retained in the area around the upper rim of the flag and the rim of said flag adjacent the flagpole, respectively, whereby said bar is firmly fixed and extends substantially in the entire plane of the flag so that between its ends it forms a curve extending upwards towards the upper corner of the flag adjacent the flagpole.

The resulting distended state of the flag ensures that said flag is kept nicely distended also when only a gentle breeze applies. The flag according to the invention provides thus an increased visibility of the flag, whereby a demand from many establishments, such as filling stations and fast-food chains, for an increased visibility of their advertisements and company flags has been met. One aspect of the invention is to make the flag appear as a flag naturally distended by the wind. This aspect can be further intensified by the bar being painted in the same color as the flag. Yet another aspect of the invention is that the bar can be reused in connection with purchase of new flags.

According to the invention it is particularly preferred that the resilient bar is retained by means of pockets accommodated along the upper rim of the flag and in the rim perpendicular thereto and parallel to and adjacent the flagpole, said pockets being adapted to receive their respective ends of the flexible bar.

The spreading of the flag can be changed according to desire and in response to the position and length of the pockets as well as to the resilience of the bar.

According to the invention the flag may comprise a fixing part for the bar in an area between the means, whereby it is ensured that the bar is kept close to the flag. Flags made of polyester may be provided with a fixing part which is provided by means of two short parallel cuts in the flag for the insertion of the bar. The fixing part may also be formed by a velcro tape sewn or glued onto the flag.

BRIEF DESCRIPTION OF THE DRAWING

The invention is explained in greater detail below with reference to the accompanying drawing, in which a preferred embodiment of a flag according to the invention is shown, said flag being hoisted on a vertical flagpole.

BEST MODE FOR CARRYING OUT THE INVENTION

The flag shown in the drawing comprises a resilient bar 1, the ends of which are retained in pockets 2 and 3 along the upper rim 4 of the flag and the rim 5 of said flag adjacent the flagpole, respectively. The bar is kept in curved state and extends substantially in the plane of the flag while forming a curve which extends adjacent to a face of the flag and towards the upper corner of the flag adjacent the flagpole. The flag comprises a fixing part 6 for the bar, said fixing part being formed by a strip of the flag provided by means of two short cuts 7 and 8 in said flag.

The resilient bar 1 is made of a steel material. It can, however, also be made of another suitable material, such as a plastic material reinforced by means of carbon fibers or glass fibers.

The pockets 2 and 3 are provided by pieces of fabric similar to the fabric of the flag being sewn or glued onto a conventional fabric flag. Thus the pockets 2 and 3 are preferably made such that as far as the color is concerned they coincide with the color of the flag. The bottom of the pockets 2 and 3 can be reinforced by means of an insertion of plastics in such a manner that the bar 1 does not wear out said pockets.

According to an embodiment of the invention the flag is of a height of 140 cm and a width of 200 cm. The bar 1 is of a diameter of 5 mm and in the straightened state it is of a length of 255 cm. The bottom of one pocket 2 is placed along the upper rim 4 of the flag and 160 cm away from the upper corner adjacent the flagpole. The bottom of the other pocket 3 is placed along the rim 5 of the flag adjacent the flagpole and 140 cm away from the upper corner adjacent said flagpole. The said pockets are both of a length of 95 cm and 70 cm, respectively.

The use of the above technique provides an outward pressure along the upper rim 4 of the flag, as illustrated by the arrow a in the drawing, as well as an upward pressure, as illustrated by the arrow b. Furthermore, a downward pressure is provided along the rim 5 of the flag adjacent the flagpole, as illustrated by the arrow c, and a backward pressure, as illustrated by the arrow d in the drawing. A tightening of the flag halyard 9 ensures that the rim 5 of the flag adjacent the flagpole is not forced behind the flagpole.

The invention has been described with reference to a preferred embodiment. Many modifications can, however, be performed without thereby deviating from the scope of the invention. The bottom of the pocket adjacent the flagpole may for instance be placed a short distance away from the lower corner. Such a position of the latter bottom applies in particular to flags of a dimension along the flagpole which is larger than the dimension measured perpendicular to said flagpole. The flag may instead of being hoisted on a flagpole also be attached in another manner, such as on a wall or the like surface.

We claim:

1. A flag, comprising a face bordered by a first rim having an end coincident with a corner of said flag, and a second rim extending from said first rim at said corner; said second rim being structured and arranged to extend substantially adjacent to a supporting structure when said flag is mounted to said supporting structure in a mounted mode; and a resilient bar having a first end retained in a first area along said first rim, an opposite second end retained in a second area along said second rim, and a middle portion extending between said areas; said resilient bar being fixed in a bent state and extending substantially in an entire plane of said flag face, said resilient bar being curved towards said corner so that said bar exerts biasing forces on said first and second rims when said flag is in a fully distended position, said middle portion being entirely located inwardly of said corner so that all of said middle portion extends adjacent to said flag face.

2. The flag of claim 1 wherein said first area comprises a first pocket adjacent said first rim and said second area comprises a second pocket adjacent said second rim, said first end extending into said first pocket and said second end extending into said second pocket.

3. The flag of claim 2 wherein said first rim is perpendicular to said second rim.

4. The flag of claim 1 further including a third area between said first area and said second area, said resilient bar being retained at said third area.

5. A flag, comprising a face bordered by a first rim having an end coincident with a corner of said flag, and a second rim extending from said first rim at said corner; said second rim being structured and arranged to extend substantially adjacent to a flagpole when said flag is mounted to said flagpole in a mounted mode; a resilient bar having a first end retained in a first area along said first rim, an opposite second end retained in a second area along said second rim, and a middle portion extending between said areas; said resilient bar being fixed in a bent state and extending substantially in an entire plane of said flag face; said resilient bar being curved towards said corner so that said bar exerts biasing forces on said first and second rims when said flag is in a fully distended position, said middle portion being entirely located inwardly of said corner so that all of said middle portion extends adjacent to said flag face; and a fixing part for the bar in a third area between said first area and said second area, said fixing part comprising a strip of the flag resulting from two short cuts therein.

6. The flag of claim 5 wherein said bar is made of steel, glass fibre or a carbon-reinforced material.

7. The flag of claim 5 wherein said first area comprises a first pocket adjacent said first rim and said second area comprises a second pocket adjacent said second rim, said first end extending into said first pocket and said second end extending into said second pocket.

8. The flag of claim 7 wherein said first rim is perpendicular to said second rim.

9. The flag of claim 7 wherein said bar made of steel, glass fibre or a carbon-reinforced material.

* * * * *